United States Patent [19]

Chang

[11] Patent Number: 4,869,308

[45] Date of Patent: Sep. 26, 1989

[54] TRANSMISSION MECHANISM FOR THE ADJUSTMENT OF INCLINATION ANGLE OF A VENETIAN BLIND

[76] Inventor: Wang S. Chang, No. 154, Cheng Kung Third Rd., Nan-Tou City, Taiwan, R.O.C., Taiwan

[21] Appl. No.: 227,158

[22] Filed: Aug. 2, 1988

[51] Int. Cl.[4] ..... E06B 9/26

[52] U.S. Cl. ..... 160/176.1; 160/166.1; 160/115

[58] Field of Search ..... 160/115, 176.1, 166.1, 160/113, 179

*Primary Examiner*—Blair M. Johnson

*Attorney, Agent, or Firm*—Brumbaugh, Graves, Donohue & Raymond

[57] ABSTRACT

An improved transmission mechanism for the adjustment of the angle of the leaves of venetian blinds, comprising two gears, a cylindrical body, a bevel gear, a shifting means and a cord. It can selectively connect the adjusting rod to a first rotary beam which controls the inclination angle of the leaves of the upper half of the venetian blind or to a second rotary beam which controls those of the lower half of the venetian blind via a cord for controlling the shifting member. It is structurally compact and simple, thus greatly saving the cost of production.

2 Claims, 9 Drawing Sheets

TRANSMISSION MECHANISM FOR THE ADJUSTMENT OF INCLINATION ANGLE OF A VENETIAN BLIND

BACKGROUND OF THE INVENTION

The present invention relates to an improved transmission mechanism for adjusting the inclination angle of the leaves of venetian blinds.

Please refer to FIGS. 6 and 7. Conventional venetian blinds are controlled by two ropes (R) and four strings (S1) (S2). The ropes (R) are used to lift the whole venetian blind up, while the strings (S1) (S2) control the inclination angle of the leaves (L) to adjust the entry of the light. The two strings are tied to a string attacher (SA) which is fixed to a rotary beam (B) in a string-hanger (SH) in the top bar (T). When the user rotates an adjusting rod (A), the torque will be transmitted througha gearbox (GB) to the rotary beam (B), so that the latter will be rotated around its own axis. The rotation of the rotary beam (B) causes one of the strings (S1) to rise and the other one to descend, thus the inclination angle of the leaves will change.

In the conventional venetian blind, all the leaves are adjusted as an entity. In other words, all the leaves are adjusted simultaneously to the same inclination. However, in some cases, not all the leaves are desired to adjust to the same inclination. Sometimes it is preferred that the leaves of the upper half of the venetian blind be kept horizontal to allow light to enter while the leaves of its lower half are adjusted to a steep inclination to intercept the light so that some of the articles in the room which are vulnerable to radiation may not be exposed to the sunlight. For this purpose, the applicant developed an adjusting mechanism for adjusting the inclination of the leaves. It comprises two rotary beams (B1) (B2). The leaves of the upper half of the venetian blind are controlled by a first set of strings (S1') (S2') which are tied to the first rotary beam (B1), while the leaves of the lower half thereof are controlled by a second set of strings (S1') (S2') which are tied to the second rotary beam (B2). The gear box (GB) and string-hangers (SH) are provided with a plurality of gears to enable one of the rotary beams (B1) (B2) to mechanically connect with the adjusting rod (A) and the other one thereof to mechanically disengaged therewith. Thus the user can selectively adjust the leaves of the upper half or the lower half of the venetian blind. This device was applied for patent in the United States (Ser. No. 06/687,763 now abandoned).

Such a device enables the upper and lower part of a venetian blind to be adjusted separately. However, its structure is relatively complicated and necessitates a number of gears whic not only exist in the gear box (GB), but also exist in each string-hanger (SH). These elements are crowded in the narrow space of the string-hander so that the strings are liable to be jammed among the gears in the string-hanger.

Accordingly it is the object of the product invention to provide an improved gear box to selectively connect any one of the two rotary beams (B1) and (B2).

According to the present invention, each of the rotary beams (B1) (B2) is provided with a gear.which is axially slidably but not rotatably mounted on the rotary beams. Both gears are retained in a shifting member and can be shifted axially by the latter between a first and a second position. The gear box is provided with an internal gear which is mechanically connected to the adjusting rod (A). When the shifting member is in its first position, the gear of the first rotary beams (B1) is engaged with the internal gear. Thus the upper half of the venetian blind can be adjusted by rotating the adjusting rod (A). When the shifting member is in its second position, the gear of the second rotary beam is engaged with the internal gear. Thus the lower half of the venetian blind can be adjusted by rotating the adjusting rod. The axial shift of the retaining member is achieved by a cord. Preferably, the internal gear is provided inside a cylindrical body which forms a crown gear at its one end. The shifting member can be received inside the cylindrical body so that the space is optimally utilized. A bevel gear engages with the crown gear. The bevel gear is connected to the adjusting rod and co-rotates with the latter. Preferably, the bevel gear and the adjusting rod are hollow to allow the cord to extend to the outside through the bevel gear and the adjusting rod.

This invention will be better understood when read in connection with the accompanying drawing, in which:

DETAILED DESCRIPTION OF PREFERRED EMBODIMENT

Figure 1:
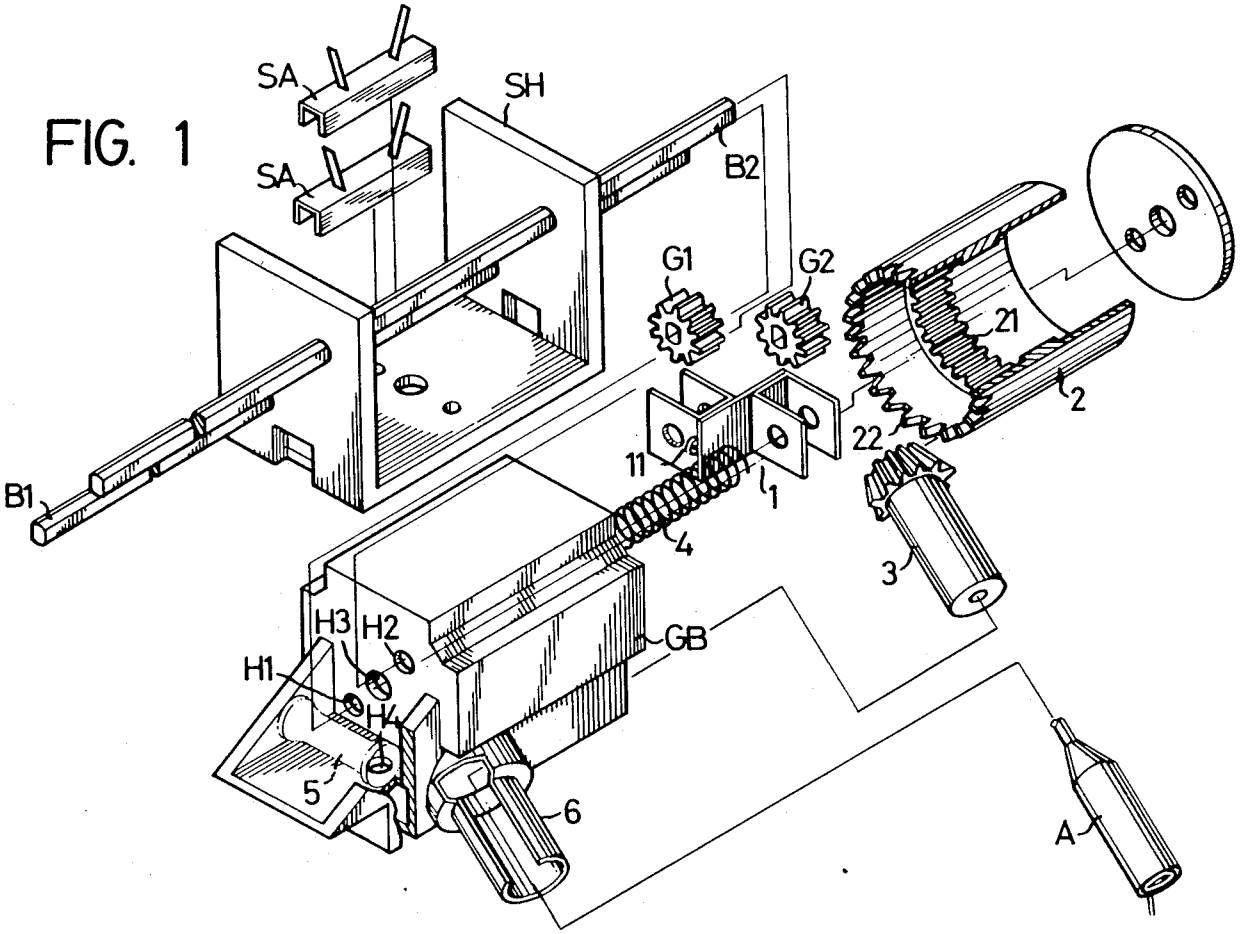
FIG. 1 is a fragmentary view of the transmission mechanism of this invention.
Figure 2A:
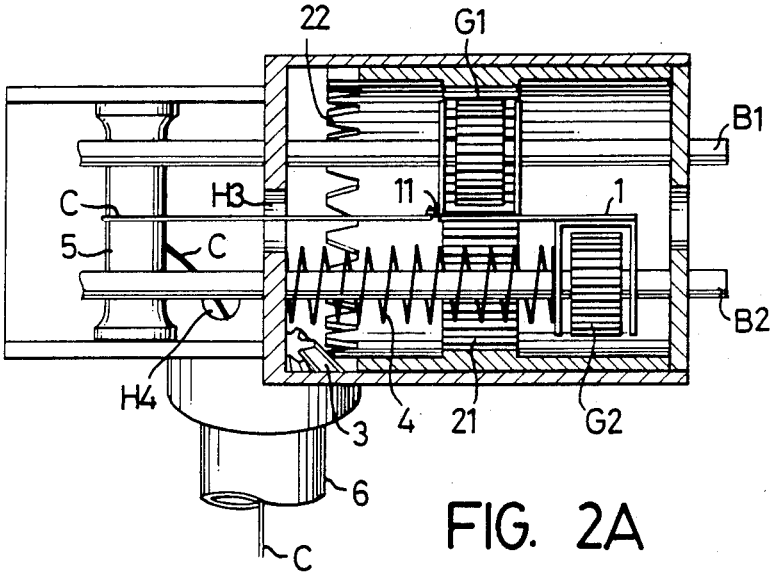
FIG. 2A and 2B are the top sectional views respectively showing the two positions of the shifting member.
Figure 2B:
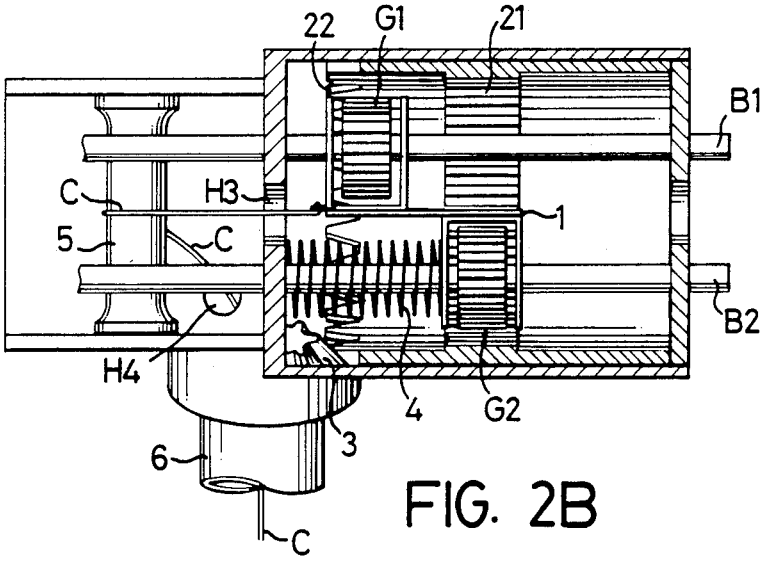
Figure 3:
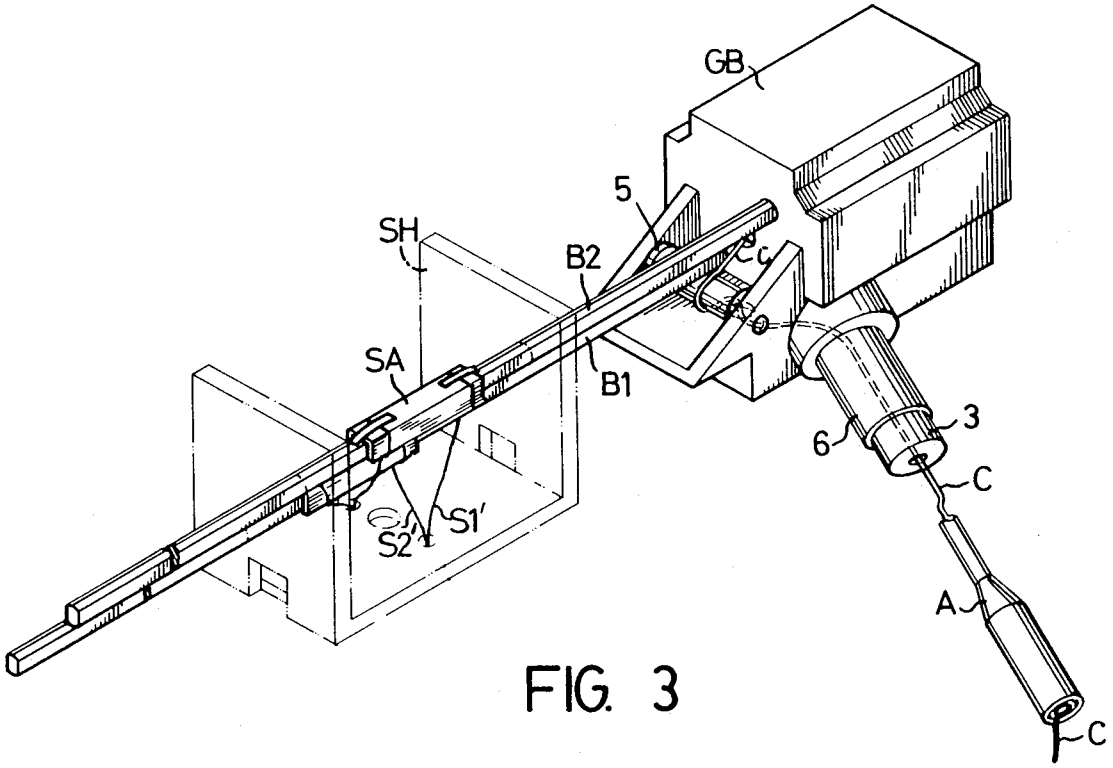
FIG. 3 is a perspective view of the transmission mechanism of this invention.

Referring to FIGS. 1 to 3, the transmission mechanism of this invention comprises two gears (G1) (G2), shifting member 1, a cylindrical body 2 in which an internal gear 21 is formed and one end of which forms a crown gear 22, and a bevel gear 3. Each of the gears (G1) (G2) are centrally provided with a slot the shape of which corresponds to the cross section of the rotary beams (B1) (B2), so that they can be non-rotatably but slidably mounted on the rotary beams (B1) (B2). The rotary beams (B1) (B2) penetrate through the shifting member 1 and the gears (G1) (G2). Thus the gears (G1) (G2) are retained in the shifting member 1 and can be shifted between the two positions (in FIGS. 2A and 2B) by the latter. In FIG. 2A, gear (G1) is engaged with internal gear 21. The bevel gear 3 is connected to the adjusting rod (A) by means of an universal joint (not shown). Since this is similar to the joining of a conventional adjusting rod, its detailed description is not necessary. When the user rotates the adjusting rod (A), the bevel gear 3 will be driven to rotate, and the crown gear 22 [and therefore the whole cylindrical body 2 and the internal gear 21]can be driven to rotate. Thus gear (G1) is driven to rotate and the rotary beam (B1) will co-rotate with gear (G1). Accordingly the leaves of the upper half of the venetian blind can be adjusted to the desired inclination angle.

In FIG. 2B, gear (G2) is engaged with internal gear 21. When the user rotates the adjusting rod (A), the torque will be transmitted via bevel gear 3, crown gear 22, internal gear 21 and gear (G2) to the rotary beam (B2). As a result, the leaves of the lower half of the venetian blind are adjusted.

The shifting member 1 is provided with an eyelet 11 to which one end of a cord 1 is tied. A compression spring 4 is provided 4 to bias the shifting member 1 toward its position in FIG. 2A. When the user pulls the cord (C), the shifting member 1 will be pulled to the position in FIG. 2B. When the user releases the cord (C), the shifting member will be pushed back to the position in FIG. 2A by the resumptive force of the compression spring 4.

The bevel gear 3 and the adjusting rod (A) are hollowed. The cord (C) extends through a hole (H3), and turns a sharp angle around a pulley 5 and then passes through another hole (H4), and travels through the passage in the bevel gear 3 and the adjusting rod (A) and emerges from the free end of the adjusting rod (A) (See FIG. 3). Aside from the two holes (H3), (H4) the gear box (GB) has two holes (H1) (H2) for the rotary beams (B1) (B2). The gear box (GB) also has a socket 6 to receive the bevel gear 3.

Figure 4B:
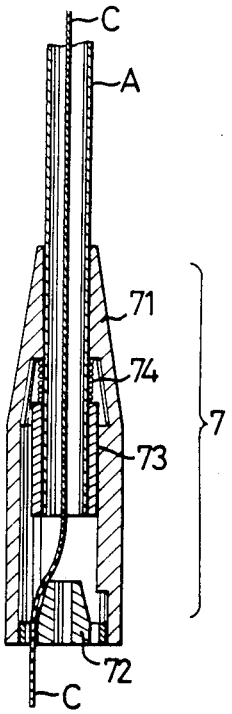
FIG. 4A and 4B are the sectional views showing the two positions of a securing means provided at one end of the adjsuting rod.
Figure 4A:
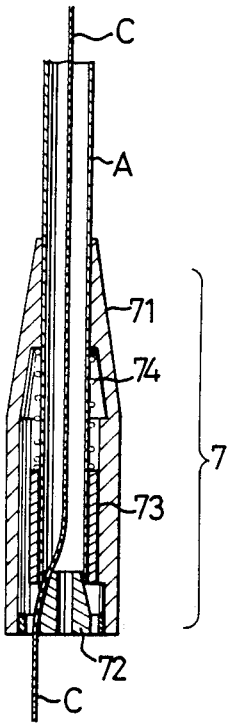
Figure 5:
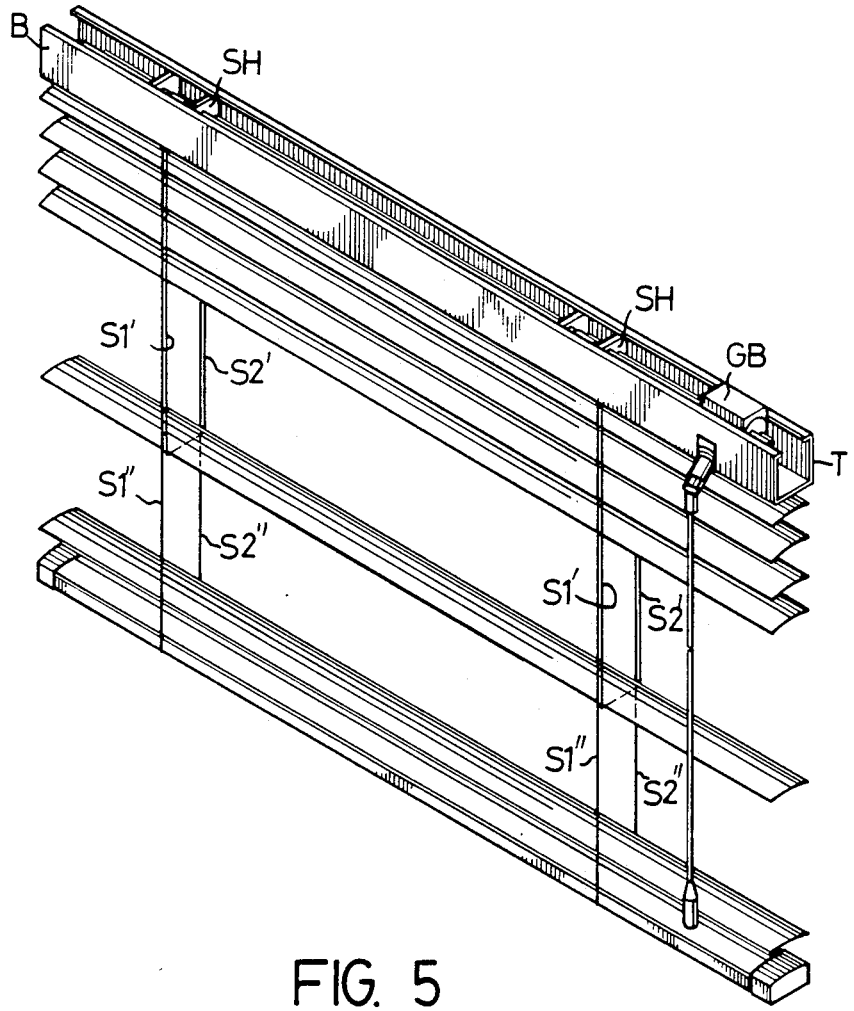
FIG. 5 is a perspective of a venetian blind provided with the transmission mechanism of this invention.

In order to fasten the free end of cord (C) so that the shifting member 1 can be kept in its position in FIG. 2B, the adjusting rod (A) is provided with a fastening means 7. Please refer to FIGS. 4A and 4B. The fastening means 7 comprises an outer tube 71 with an end piece 72, an inner tube 73 slidably retained in the outer tube 71 and a compression spring 74 which biases the outer tube 71 towards its position in Fig. 4A. The end piece 72 is fixed in the outer tube 71. The outer tube 71 is slidably retained at one end of the adjusting rod (A), while the inner tube 73 is fixed thereon. Normally the inner tube in position of FIG. 4A and the cord (C) is clamped between the inner tube 73 and end piece 72. If the user desires to adjust the lower half of the venetian blind, he must firstly use his one hand (for example, left hand) to pull the outer tube down to its position in FIG. 4B and hold it in this position so that the cord (C) is no longer clamped by the inner tube 73 and end piece 72. Now he can use his another hand to pull the cord (C) to bring the shifting member 1 to its position in FIG. 2B. Now he can release the outer tube 71 so that the latter will rise up to its position in FIG. 4A by the respective force of the spring 74, hence the cord (C) is clamped between the inner tube 73 and end piece 72 again. Now he can release the cord (C). Since the cord (C) is fastened by the end piece 73 and inner tube 73, the shifting member 1 will not be pushed back to its position in FIG. 2A, but still remains in the position in FIG. 2B. So he can adjust the lower half of the venetian blind without using the other hand to fasten the cord (C). If the user pulls the outer tube 71 down, the cord (C) will be released, so the shifting member 1 will be biased back to its stable position in FIG. 2A.

Figure 6:
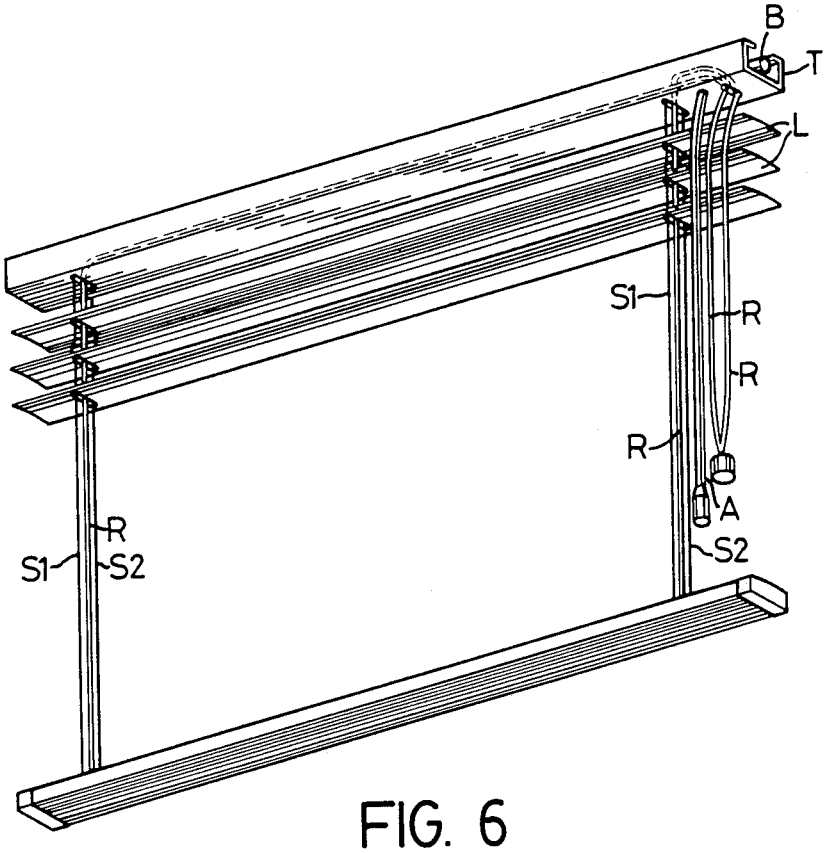
FIG. 6 PRIOR ART
FIG. 6 and 7 show a conventional venetian blind and its mechanism for the adjustment of the leaves.
Figure 7:
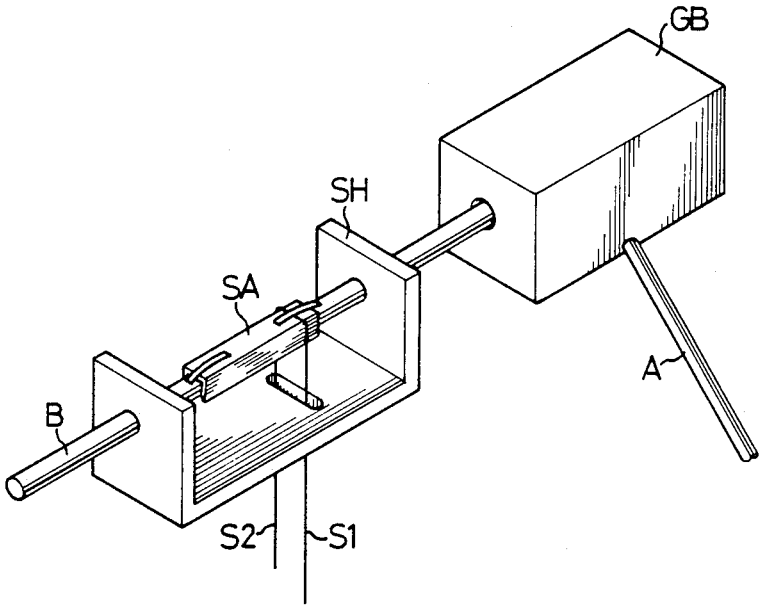
FIG 7 PRIOR ART
Figure 8:
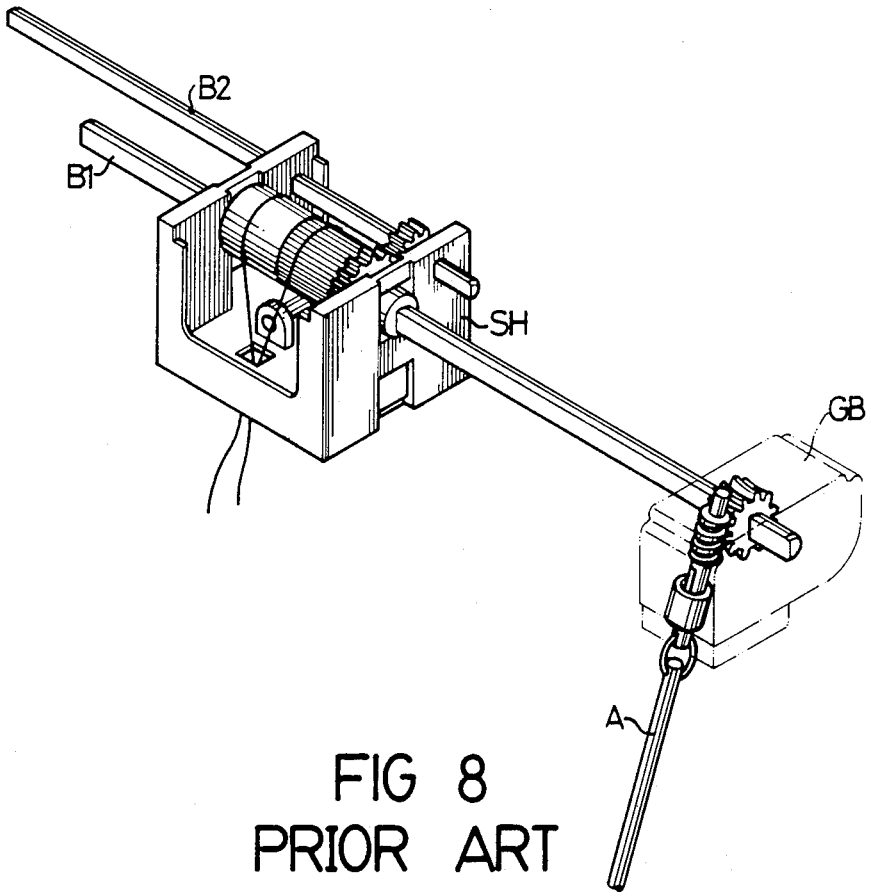
FIG 8 PRIOR ART
FIGS. 8 and 9 shows a transmission mechanism for the leaves of a venetian blind previously developed by the applicant and its transmission mechanism.
Figure 9:
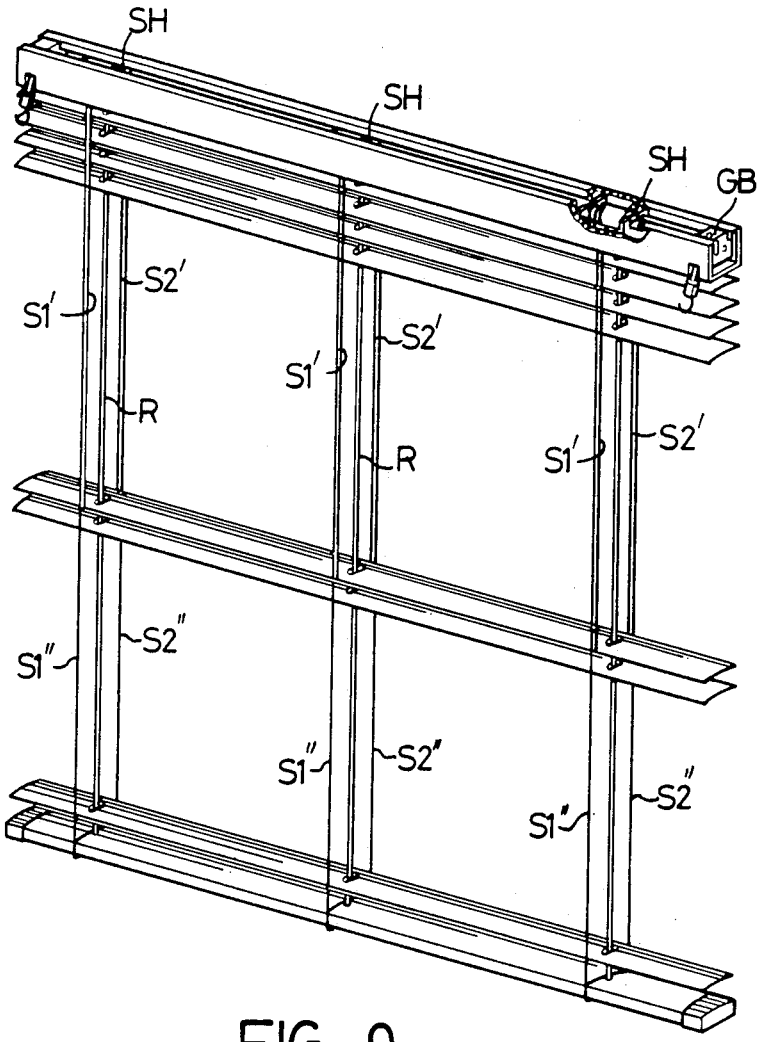
FIG 9 PRIOR ART

When using the present invention, the string-hanger (SH) is not provided with gears, and is similar to that of a conventional venetian blind in FIGS. 6 and 7. Thus its detailed discription can be omitted. The only difference consists in that here the string-hanger (SH) is penetrated by two rotary bars (B1) (B2) instead of one.

The transmission mechanism according to this invention only necessitates four gearing members (G1) (G2), 2, and 3, thus greatly reducing its cost of production. The gears (G1) (G2) and the shifting member 1 are received inside the cylindrical body 2 to utilize the interior of the latter, which is snugly received in the gear box, thus forming an extremely compact structure. Accordingly the narrow space of the gear box is optimally exploited.

I claim:

1. A transmission mechanism for the adjustment of the inclination angle of leaves of a horizontal venetian blind, of which the leaves of the upper half and lower half of the blind are respectively suspended and controlled by a first set of strings and a second set of strings which are respectively tied to a first rotary beam and a second rotary beam, said venetian blind having an adjusting rod one end of which is selectively mechanically connected via said transmission mechanism with either one of said first and second rotary beams, said transmission means comprising a bevel gear which is connected to one end of said adjusting rod, characterized by that said transmission mechanism comprises a first gear slidably but non-rotatably mounted on said first rotary beam, a second gear slidably but non-rotatably mounted on said second rotary beam, a hollow cylindrical body which forms an internal gear in its inner surface and a crown gear at one end which engages with said bevel gear, and a shifting member for shifting said first and second gears, which are located on said shifting member, between a first position in which said first gear engages with said internal gear, thereby allowing rotation of said first rotary beam and tilting of said upper half of said leaves and a second position in which said second gear engages with said internal gear, thereby allowing rotation of said second rotary beam and tilting of said lower half of said leaves, and means for moving said shifting member and said first nd second gears between said first position and said second position.

2. The transmission mechanism according to claim 1, wherein said means for moving said shifting member is a cord of which one end is attached to said shifting member.

* * * * *